United States Patent [19]

Brilmyer et al.

[11] Patent Number: 4,710,280

[45] Date of Patent: Dec. 1, 1987

[54] METHOD AND APPARATUS FOR ELECTROCHEMICALLY CLEANING GUN BORES AND THE LIKE

[76] Inventors: George H. Brilmyer, 1009 Sherman Rd., Cedarburg, Wis. 53012; Dennis L. Marshall, 2006 N. 107th St., Wauwatosa, Wis. 53226

[21] Appl. No.: 859,437

[22] Filed: May 5, 1986

[51] Int. Cl.[4] ..... C25F 5/00; C25F 7/00

[52] U.S. Cl. ..... 204/146; 204/272

[58] Field of Search ..... 204/141.5, 145 R, 146, 204/272, 26

[56] References Cited

U.S. PATENT DOCUMENTS

| | | | |
|---|---|---|---|
| 908,937 | 1/1909 | Bayliss et al. | 204/212 |
| 1,050,678 | 1/1913 | Moreno | 423/32 |
| 1,484,690 | 2/1924 | Walker et al. | 42/1 BC |
| 2,561,222 | 7/1951 | Passal | 204/146 |
| 2,581,490 | 1/1952 | Larsen | 204/146 |
| 3,826,724 | 7/1974 | Riggs, Jr. | 204/146 |
| 3,943,043 | 3/1976 | Billington et al. | 204/146 |
| 4,125,447 | 11/1978 | Bachert | 204/26 |

FOREIGN PATENT DOCUMENTS

| | | | |
|---|---|---|---|
| 299298 | 7/1929 | United Kingdom | 204/146 |

OTHER PUBLICATIONS

Harrison, "Cast Bullets", *National Rifle Association,* 1979, p. 33.

"Reloading Manual Number Ten for Rifle and Pistol", Omark Industries, 1979, p. 364.

*Primary Examiner*—T. M. Tufariello

*Attorney, Agent, or Firm*—Joseph J. Jochman, Jr.

[57] ABSTRACT

The metal fouling which is deposited in the bores and other interior parts of firearms as a result of firing is selectively removed by an electrochemical process which is innocuous to the ferrous base metal of the firearm. A low voltage d-c potential is applied between the ferrous base metal of the firearm to be cleaned, which is maintained as the positive electrode with respect to an auxiliary electrode which is, for example, inserted into the bore and electrically insulated therefrom. An electrolyte occupying the space between the interior of the bore and the auxiliary electrode is selected to be non-oxidizing to the ferrous base metal and capable of solubilizing the electrochemically oxidized metal fouling to be removed. Metal fouling or deposits are completely removed without affecting the ferrous base metal of the bore. The auxiliary electrode onto which the metal fouling is electrodeposited may conveniently comprise a long, narrow brush with a conductive rod and nonconductive bristles, the latter acting to maintain electrical separation of the electrodes. The low voltage d-c potential may be applied with a d-c power source or a potentiostat with suitable reference electrode. The method may also be applied to cleaning dies and molds used in die casting and powder metallurgy or the like, where the build-up of metal or metal oxide deposits adversely affects quality, accuracy, or tolerance and repeated abrasive or other cleaning is undesirable.

21 Claims, 2 Drawing Figures

METHOD AND APPARATUS FOR ELECTROCHEMICALLY CLEANING GUN BORES AND THE LIKE

BACKGROUND OF THE INVENTION

The present invention relates to the art of electrochemically removing undesirable or harmful metal deposits from ferrous base metals and, in a principal embodiment, the invention pertains to a method and apparatus for electrochemically removing from the bores of firearms metal bullet fouling which is deposited therein.

The metal deposits and other residues left in the bores and other interior parts of firearms as a result of the firing of bullets or other types of ammunition must be periodically removed. The firing of both percussive and non-percussive ammunition results in the deposit on the bore of a firearm or gun system of a layer of metal from the projectiles, as well as carbon and other fouling from the gunpowder or firing charge. If the fouling is not periodically removed, the accuracy or function of the firearm and the integrity of the ferrous metal bore and other interior parts will be adversely affected.

Bore cleaning methods are well established in the prior art and, in general, include various combinations of mechanical abrasion and chemical oxidation or dissolution of the fouling. The methods, apparatus and chemicals used have changed very little in a century or more and the basic process is characterized by tedious and time-consuming work. Also, many of the cleaning solvents used pose significant health hazards because of their volatility and/or toxicity. Furthermore, similar prior art methods and materials have been used both for conventional firearms, like those used for hunting and target shooting, and larger or more sophisticated weapons, such as those used in military or police applications.

Metal fouling is the most difficult of the foulant materials to remove from the bore of a firearm. Metal fouling may comprise a layer of lead or lead alloy from firing lead or partially-jacketed bullets; or copper, gilding metal or other copper alloy metals from jacketed bullets. The layer of metal fouling is most commonly removed by wetting the interior of the bore with a solvent or penetrant which dissolves or loosens the metal fouling. Various types of brushes are frequently used to aid loosening. The residue is then removed from the bore with a cloth patch on a cleaning rod. For harder or thicker metal layers, abrasive cleaners applied with a patch or metal-bristled brush, with or without solvents, are often used. In cases of severe lead fouling, medium-fine steel wool, wound around a brass-bristled brush, has been recommended.

In another method for removing copper or copper alloy fouling, a firearm may be placed muzzle up, the chamber end of the bore plugged, the barrel filled with an aqueous ammonia solution and allowed to stand for several hours until the metal fouling is chemically oxidized and dissolved. The bore is then brushed and swabbed as discussed above. However, the ammonia concentration in some formulations is sufficiently high that contact with the eyes is dangerous and the evolution of noxious fumes inhibits indoor use. Also, in instances of heavy fouling, multiple treatments of this type may be required.

One other prior art method used to remove lead fouling involves treating the bore with mercury to form a lead-mercury amalgam which loosens and/or dissolves the lead from the bore for relatively easy removal. However, the high toxicity and hazards related to the handling and use of mercury are well known and this method is, therefore, extremely unsafe, regardless of its efficacy.

Repeated cleaning of firearms by the foregoing methods, particularly those using abrasive brushing, are known to measurably wear the precision bore surfaces, adversely affect performance and accuracy, and result in shorter useful life. The potential damage to firearms resulting from necessarily severe abrasive cleaning of heavily leaded bores is well documented, as is the absence of safe and effective alternate methods. See, for example, E. H. Harrison, "Cast Bullets," National Rifle Association, 1979, p. 33; and, "Reloading Manual Number Ten for Rifle and Pistol," Omark Industries, Inc., 1979, p. 364.

U.S. Pat. No. 1,050,678 describes an embodiment of one of the foregoing processes using aqueous ammonia or methylamine in the presence of air. U.S. Pat. No. 1,484,690 discloses the use of a bore cleaning mixture of ammonium persulfate, ammonium sulfate and an alkali in aqueous solution to remove copper or cupro-nickel fouling. However, ammonia-based solutions are most commonly used today and little if any improvement has been made in this tedious and time-consuming process since its first use three-quarters of a century ago.

U.S. Pat. No. 1,050,678 also discusses the use of electrolysis to remove copper fouling from gun bores, but discloses no specific method and dismisses its use generally because of electrochemical attack on the base metal of the gun barrel (page 1, lines 68–83). The inventors herein are aware of no other prior art disclosing the use of electrochemical cleaning processes for the selective removal of gun bore metal fouling.

The prior art also discloses various methods for electrolytically stripping nonferrous metal coatings from ferrous base metals. U.S. Pat. No. 2,561,222 describes a method of stripping lead, copper, zinc and other metal electrodeposits from ferrous base metals in an electrolytic bath consisting of sodium nitrate and chromic acid and with controlled current densities at the coated ferrous metal positive electrode in the range of ¼ to 4 amps/in.$^2$. Although the method purports to avoid excessive attack on the ferrous base metal, the electrolytic action is described as producing an appreciable smoothing of the ferrous base by removing small burrs and projections. The disclosed electrolyte is in fact highly oxidizing to iron and, at the current densities applied, would result in totally unacceptable corrosion of the rifling and surfaces of the steel bore of a firearm, particularly if used repeatedly.

A similar electrolytic stripping process is disclosed in U.S. Pat. No. 2,581,490 wherein copper, nickel, or chromium coatings are removed in a bath consisting of sodium nitrate and an alkali metal hydroxide to which sodium nitrite is added to prevent etching of the ferrous base metal. However, the disclosed electrolytic solution is also highly oxidizing and, although its use may be wholly acceptable for processing commercial steel sheet, it would be unacceptable for use on the precision bores of firearms. In addition, the process operates at relatively high current densities and temperatures and requires the use of chemicals which pose substantial health hazards.

Thus, the prior art discloses no processes or methods for eliminating or alleviating the tedious, time-consuming and sometimes hazardous task of removing metal fouling from the bores of firearms. There is, as a result, a need for a simple, convenient and fast method for removing metal fouling which is neither hazardous to the user nor harmful to the precision surfaces of the firearms.

It is also known that metal fouling or contamination is a serious problem in certain precision molding and casting arts. For example, in the art of powder metallurgy, adherent metal powder deposits on the mold surfaces must be periodically removed and, likewise in the die casting art, so-called "soldering" of cast metal deposits on internal die surfaces presents similar problems. Not only does contamination of precision molds and dies with metal from the formed parts result in unacceptable dimensional variations, but cleaning such metal deposits is typically done manually with abrasives, is tedious, and must be done with great care to avoid damaging the dies and molds themselves. A simple, safe and effective method for cleaning precision dies and molds is, therefore, most desirable.

SUMMARY OF THE INVENTION

The present invention provides a safe, rapid and effective process for electrolytically removing nonferrous metal fouling deposits from gun bores and other precision ferrous base metal cavities, chambers, or the like. The invention is also directed to an apparatus useful in specifically applying the inventive process to cleaning metal fouling from the bores of firearms.

It has been found that, under an applied and carefully controlled d-c potential and in the presence of certain electrolytic solutions, metal deposits in the bores of steel firearm barrels can be electrochemically oxidized and subsequently dissolved without affecting the ferrous base metal of the bore. The dissolved metal is electrolytically transferred to and deposited on an auxiliary electrode placed within the bore and maintained spaced and electrically insulated from the bore. The required controlled potential may be maintained potentiostatically with the use of a suitable reference electrode, or by a d-c power source used in conjunction with preferential doping of the electrolytic solution with ions of the metal to be removed. In the absence of potentiostatic control, preferential ion doping is used to establish and maintain an equilibrium condition at the auxiliary electrode which promotes continuous and complete electrolytic removal of the fouling metal. By maintaining the ferrous base metal (e.g. gun barrel) electrically positive, nonferrous metal layers are easily and effectively removed and deposited on the negative auxiliary electrode.

The cleaning process is always operated at very low potential (e.g. 2 volts or less) thereby precluding any electrical hazard. In addition to being innocuous to the ferrous base metal, the method of the present invention is safe and presents virtually no hazard to the user when properly practiced in accordance with the teaching hereinafter set forth. A unique feature of the method of the present invention is that the controlled-potential cleaning process continues to operate without attention or adjustment as long as any amount of the metal selected for removal remains on the base metal and, when all fouling metal is removed, the flow of current automatically drops to near zero and the process ceases operating. Further, because the process results in no measurable corrosion of the ferrous base metal, the possibility of progressive wear on gun bores caused by prior art abrasive cleaning is virtually eliminated.

With proper selection of electrolytes and appropriate potential control, all of the commonly-encountered metal deposits may be removed from ferrous metals. The method may thus be used to remove all metal fouling deposited from the commonly used bullet and shell metals, including lead, lead alloys, copper-based jacket metals and other typical metal alloys which are widely used.

In its preferred embodiment, as applied to removing metal fouling from the bores of firearms, the method disclosed herein may be practiced with the use of relatively simple apparatus and materials. Thus, the auxiliary electrode on which the removed fouling metal is electrodeposited may comprise a long brush with an electrically conductive rod and nonconductive bristles. The rod acts as the negative electrode in the impressed-potential system and the bristles serve to maintain electrical separation between the rod and gun bore, the latter maintained as the positive electrode in the system.

The apparatus used in the foregoing method may be readily adapted to cleaning a cavity of any shape by constructing an auxiliary electrode to suitably fit therein. Thus, in a modified embodiment of the invention, adherent metal oxide deposits, such as those occurring on the interior surfaces of powder metallurgy dies in the formation of metal oxide products, may be removed by using a preliminary step of electrochemically reducing the oxide deposit to its elemental metal. This is accomplished by initially applying the current in the opposite direction, i.e. with the auxiliary electrode maintained electrically positive and the die correspondingly negative. Subsequent current reversal operates to remove the remaining elemental metal deposit in the manner of the principal embodiment of the invention. Of course, directly deposited adherent metal layers may be removed from these surfaces by the method of the preferred embodiment.

The method of the present invention operates in a general sense on basic principles of electrolysis known in the prior art. However, absent from the prior art are the critically important teachings of maintaining a controlled potential to avoid electrochemical attack on precision ferrous base metal parts, and electrolytic solutions which are effective in reaching the foregoing objectives without promoting direct chemical attack on the base metal, but which are relatively safe and easy to use.

DESCRIPTION OF THE PREFERRED EMBODIMENTS

The nonferrous metal fouling typically deposited in the bores of firearms as a result of firing is, in general, either lead or copper, including alloys of those metals. Unjacketed lead bullets may typically consist of antimony in the range of 0 to 12% by weight and tin in the range of 0 to 10% by weight, the remainder being essentially lead. The buildup of lead fouling in the bore of a firearm is fairly rapid and results in a noticeable and measurable layer. Jacketed bullets are generally covered with a thin layer of copper or a copper alloy such as gilding metal or commercial bronze. The layer of fouling from such projectiles is thus principally copper with small amounts of zinc.

Figure 1:
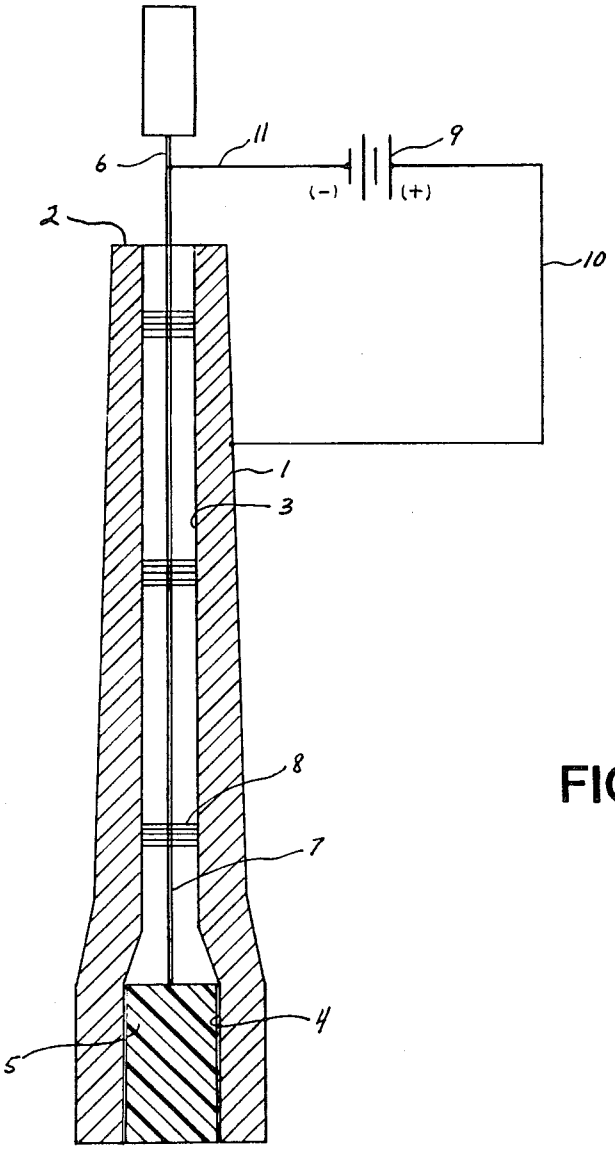
FIG. 1 shows an axial section of the barrel of a firearm to which is attached a preferred embodiment of apparatus used to practice the method of the present invention.

Relatively inexpensive and easy-to-use apparatus may be employed to practice the method of the present invention. Referring to FIG. 1 of the drawing, the barrel 1 of a firearm (not otherwise shown) is placed to stand in a vertical position, most conveniently with the muzzle end 2 pointing upwardly. The bore 3 is sealed at its lower or chamber end by inserting into the cartridge chamber 4 a suitable plug 5 of rubber or plastic material which should be chemically inert, electrically nonconductive and flexible enough to remain in place and provide a tight liquid seal. A long, narrow brush 6 is inserted into the bore 3 from the muzzle end until its lower end contacts the plug 5. The brush 6 comprises a conductive rod 7, which may be brass or any other suitable metallic or nonmetallic material, and radially extending bristles 8 of plastic or other nonconductive material which is inert to chemical or electrochemical attack by the electrolytes to be hereinafter described. The bristles should be of sufficient length and stiffness to establish and maintain separation and insulation of the conductive rod 7 from the ferrous metal bore 3 of the barrel. The bristles need not extend the full axial length of the rod, but need only be of sufficient extent and location to provide the required separation as shown. Separation may, of course, be provided by other suitable means. A suitable nonmetallic material for the conductive rod includes graphite or a graphite-epoxy composite.

After insertion of the brush 6, the bore 3 is filled with an electrolytic solution selected to provide the necessary ionic conductivity under the influence of an impressed d-c potential, to provide dissolution of the electrolytically oxidized metal fouling, and to be innocuous to the ferrous metal bore (and other iron or steel parts of the firearm into which it may inadvertently come in contact). Various electrolytic solutions, both aqueous and non-aqueous, may be used for each primary fouling metal, as will be more fully described hereinafter.

As shown in FIG. 1, a source of constant potential direct current, such as a battery 9, is connected between the barrel 1, via lead 10, and the rod 7, via lead 11, such that a positive potential is impressed on the barrel. The rod 7 is correspondingly maintained negative with respect to the barrel and functions as an auxiliary electrode upon which the nonferrous metal is electrodeposited from solution as the metal fouling is removed from the bore. The potential difference between the bore 3 and the rod 7 is chosen to maintain the bore sufficiently positive with respect to the auxiliary electrode to oxidize the nonferrous metal, that is, the potential of the bore must be maintained slightly positive of the equilibrium potential of the metal to be removed. This can be done through the use of a potentiostat and suitable reference electrode, shown in FIG. 2, or by purposely doping the electrolyte solution with ions of the metal to be removed and applying a low d-c voltage, as with the battery 9 in FIG. 1.

To electrochemically remove lead fouling, an aqueous solution of 0.5 molar ammonium acetate (38.5 grams/liter) is a preferred electrolyte. Ammonium acetate has no direct chemical or electrolytic effect on steel, but provides the electrolytic conductivity necessary for the electrochemical oxidation of the metallic fouling, and acts to enhance the dissolution of the oxidized lead. If a potentiostat is not used, the electrolyte is further preferentially doped with lead ions to establish in the electrolytic solution an equilibrium electrolytic condition which promotes uniform and continuous deposition of lead on the auxiliary electrode. Doping with lead ions also eliminates the need to monitor and adjust the potential and to maintain the lead ion concentration in the electrolyte. Most conveniently, the electrolytic solution may be doped with approximately 0.02 molar lead(II) acetate (6.50 grams/liter) which is compatible with the base electrolyte and innocuous to the steel bore. It should be noted that an aqueous solution of lead acetate alone may also be effectively used. However, as previously mentioned, ammonium acetate in the electrolyte enhances the dissolution of the electrochemically oxidized lead fouling. In addition, lead acetate is not very soluble in water, but is substantially more soluble in aqueous ammonium acetate.

Since metallic lead is by far the predominant constitutent of lead fouling deposited in the bore, the minor amounts of alloying metals such as antimony and tin, as well as other usual non-metallic fouling deposits, if not oxidized themselves, simply loosen or fall off as the layer of lead fouling is removed. To the extent that these minor components of the fouling layer are not actually dissolved in the electrolyte, they are conveniently swept away with the electrolyte when the bore is emptied or may be swabbed from the bore in the conventional manner after the electrolyte is removed.

Copper or copper alloy fouling, the latter occurring primarily through the use of so-called jacketed bullets, is removed in a manner similar to lead. Thus, an aqueous electrolyte of 0.5 molar ammonium acetate has been found to be particularly well suited because ammonium acetate promotes the solubilization of copper ions. If a potentiostat is not used, the aqueous electrolyte is preferentially doped with copper ions supplied by dissolving therein a suitable copper salt, such as copper(II) acetate. However, because copper ions in solution react spontaneously with iron in a direct replacement reaction, it has been found that only very low concentrations of copper ions can be tolerated. The addition of not more than 0.02 molar copper(II) acetate (3.62 grams/liter) is suitable and will not promote any adverse reaction with the ferrous metal of the bore. The acetate salt of copper also appears to have the beneficial effect of lowering the spontaneous reactivity of copper with iron. Similarly as in the case of lead alloy fouling, the alloying metals typically used with copper, such as zinc, are either dissolved and codeposited on the auxiliary electrode with the copper or loosened and fall into the aqueous electrolyte.

The method disclosed herein is effectively operated at very low d-c potential. Thus, potentials in the range of 0.15 to 0.30 volts have been found to be adequate and it is believed that, for all usual metal fouling layers, a potential in excess of 2 volts would not be needed. In all cases, the current density is effectively controlled by the amount of metal fouling on the bore surface and remains at a low level. The practice of the method, therefore, does not expose the user to any electrical hazard. Furthermore, the method may be carried out at room temperature, thereby obviating the potential hazard of handling high temperature liquids. The electrolytes do not evolve toxic vapors and can, therefore, be safely used indoors with normal ventilation.

Figure 2:
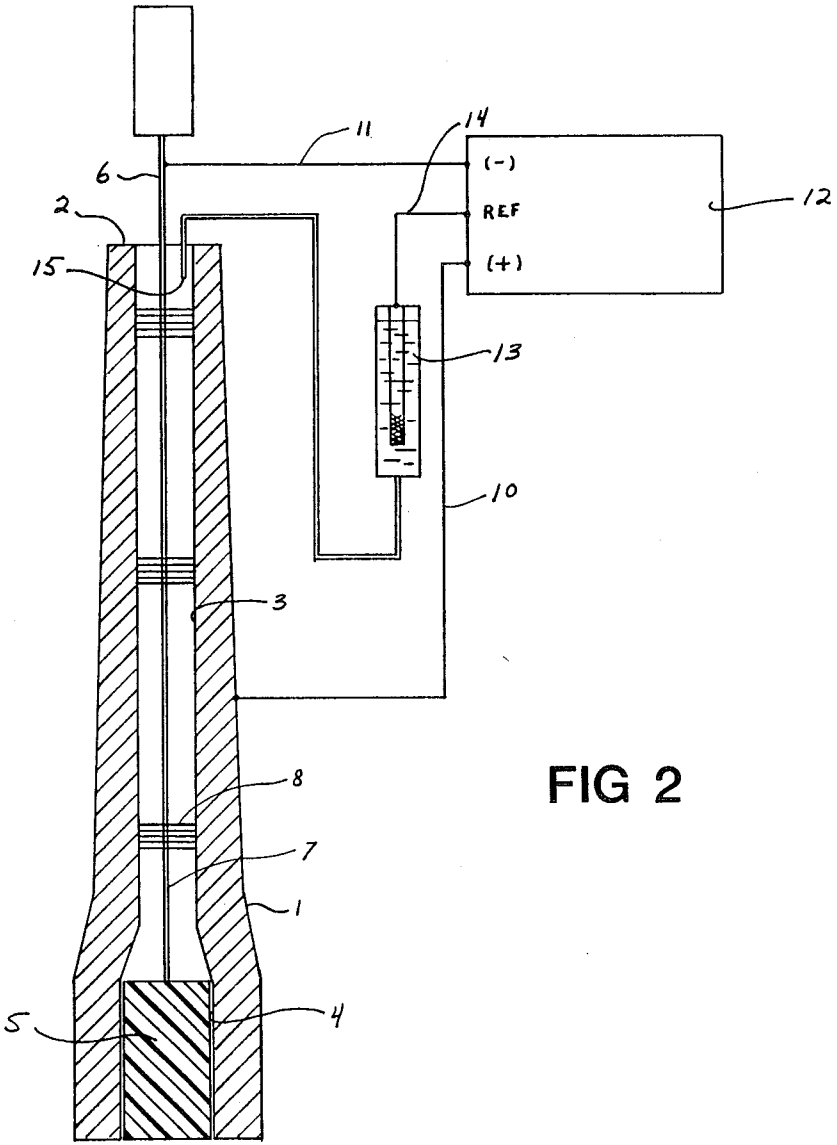
FIG. 2 is a view similar to FIG. 1, but shows the use of a potentiostat and associated reference electrode as the direct current power source instead of a battery or d-c power supply.

Referring to FIG. 2, an alternate embodiment of the invention utilizes a potentiostat 12 and reference electrode 13 to provide the controlled d-c potential, instead of the battery 9 in the FIG. 1 embodiment. Other elements of the apparatus in FIG. 2 are identical to those shown in FIG. 1 and are numbered identically.

The positive terminal of the potentiostat 12 is connected by lead 10 to the barrel 1 and the negative terminal is connected by lead 11 to the conductive rod 7 of brush 6. The reference terminal (REF) of the potentiostat is connected to a reference electrode 13 via lead 14. The reference electrode may be of any of the well known and commonly used types, such as a saturated calomel reference electrode. The free end or tip 15 of reference electrode 13 must be inserted into the bore 3 and in contact with the electrolyte. The potentiostat is adjusted to provide a potential difference between the bore and the reference electrode just slightly positive of the equilibrium potential of the fouling metal to be removed. As mentioned above, the use of a potentiostat eliminates the need to preferentially dope the aqueous electrolyte with ions of the fouling metal. The process otherwise operates in the manner described in the following Example 1.

EXAMPLE 1

The bore of a Colt Gold Cup, Mark IV, 0.45ACP pistol barrel, 5 inches in length, was cleaned as follows. The bore was fouled with 25 rounds of , 0.45ACP ammunition consisting of a dry lubricated, 210 grain cast lead bullet and 4.5 grains of powder. Lead fouling streaks were clearly visible on the lands and grooves of the bore. The weight of lead fouling was estimated to be 0.5 grains. The pistol bore was pre-cleaned with a commercially available bore cleaning solvent and wire brush to remove powder fouling and loose particulate matter. Following this, the bore was degreased with a conventional carburetor cleaner and dried with several clean patches. Lead fouling was still clearly visible in the bore for several inches ahead of the chamber area.

The bore was plugged from the chamber end with a rubber stopper and supported in a vertical position. A brush (auxiliary electrode) having a brass shaft (0.06 inch diameter), and nylon bristles (bristle diameter 0.375 inches and 6 inches long) was inserted into the bore until it contacted the chamber plug. The bore was then filled with an aqueous solution consisting of 0.5 moles/liter (38.5 grams/liter) ammonium acetate and 0.02 moles/liter (6.50 grams/liter) lead(II) acetate. A d-c power source was adjusted to provide an output of 0.30 volts and was capable of delivering a maximum current of 1 amp. The positive lead of the d-c power source was connected to the pistol barrel and the negative lead was attached to the shaft of the brush. Both connections were facilitated by the use of alligator-type clamps. The electrochemical removal of lead fouling was initiated by switching on the power supply and the progress of the cleaning process was monitored with a d-c current meter. Removal of the lead fouling took approximately 30 minutes and was slightly accelerated by periodic rotation of the brush within the bore. During the cleaning process the initial current of about 20 milliamps decreased sharply and attained a constant value of about 5 milliamps within the first 5 minutes of cleaning. Completion of the cleaning was indicated by a very rapid decrease in the measured current to a nearly constant value of less than 1 ma. The power source was switched off and the leads were disconnected. The cleaning brush (auxiliary electrode) was then removed and rinsed of visible leady deposits. The presence and location of lead deposits on the conductive shaft of the brush provide a visual indicator of not only the progress of leading removal, but also the relative concentration of leading in the bore as a function of barrel length. In this example, the deposit on the auxiliary electrode was heavier at the chamber end of the pistol barrel than at the muzzle end. Following cleaning, the electrolyte was emptied from the bore, the rubber stopper was removed and the bore was rinsed with water. The bore was then dried with two clean patches and swabbed with two patches saturated with bore solvent to provide temporary rust protection. It was noted that the first of the two solvent-soaked patches contained appreciable fouling residue, even though the solvent patch used immediately prior to the electrochemical cleaning procedure had shown little or no evidence of fouling.

EXAMPLE 2

Copper fouling was removed from a 5 inch section of a 0.308 Win caliber rifle barrel as follows. The exact history of the rifle bore was unknown. For test purposes, the rifle bore was first sectioned into 5 inch lengths and copper fouling was clearly visible on the lands and grooves of the bore. The weight of the fouling was estimated to be on the order of 0.2 grains. The bore section was pre-cleaned, degreased and dried in the same manner described in Example 1. Copper fouling was still clearly visible in the bore when examined at both ends with reflected light.

The bore was plugged at the chamber end with a teflon coated stopper, supported in a vertical position and a brush having a brass shaft and nylon bristles was then inserted into the full length of the bore until it contacted the plug. A commercially available saturated calomel reference electrode (SCE) was then positioned in the upper portion of the bore. The bore was filled with a solution of dimethylformamide containing 0.1 moles/liter (12.2 grams/liter) sodium perchlorate and 0.02 moles/liter (3.62 grams/liter) copper(II) acetate. A potentiostat capable of delivering a maximum current of 1 amp was adjusted to provide an output of +0.2 volts vs. the SCE. The working electrode lead of the potentiostat was connected to the rifle bore, the auxiliary lead was connected to the brass shaft of the brush, and the reference electrode lead was connected to the SCE.

In this example, the cleaning process was accelerated by mechanical vibration of the brush throughout the entire cleaning period. A motorized engraving tool was positioned above the bore and the vibrating tip of the tool connected to the brush. Connection of the engraver tip to the shaft of the brush was accomplished with a Plexiglas connecting rod. This was done to make mechanical connection between the vibrator and the brush without making electrical contact. The electrochemical removal of the copper fouling was then initiated by switching on the potentiostat and simultaneously turning on the engraver motor. The cleaning rate and process was monitored with d-c current meter of the potentiostat. Removal of the copper fouling took approximately 40 minutes. The initial cleaning current was about 16 milliamps. After 5 minutes of cleaning, the current reached a constant value of 5 milliamps. Completion of the cleaning process was indicated by a gradual decrease in the measured current to a value of less than 1 milliamp. The engraver motor was turned off for several short periods during the cleaning process to determine the effect of vibration on the cleaning process. The mechanical vibration of the brush was estimated to double the relative cleaning rate.

At the end of the cleaning period, the potentiostat was switched off and the leads disconnected. The cleaning brush (auxiliary electrode) was then removed. The presence and location of copper deposits on the shaft of the auxiliary electrode were relatively uniform, giving an indication of the uniformity of the fouling. The electrolyte was then emptied from the bore, the plug removed and the bore rinsed with tap water. The bore was then dried and swabbed as in Example 1. It was noted that the first dry patch and the first of the two solvent-soaked patches contained appreciable fouling residue. The barrel section was then sectioned lengthwise and inspected with the aid of a low power microscope (20×). All visible copper deposits in the bore were eliminated with the exception of the area of the bore which contained the plug.

EXAMPLE 3

The bore of a Colt Gold Cup, Mark IV,, 0.45ACP pistol barrel, 5 inches in length, was electrochemically cleaned as follows. The bore was first fouled with 25 rounds of factory 0.45A CP, 185 grain, jacketed target ammunition. Gilding metal fouling was clearly visible within the barrel and was mainly present on the upper edges of the lands and near the center of the grooves. The weight of gilding metal fouling was calculated to be 0.2 grains based on weighing the barrel before and after firing.

The pistol bore was pre-cleaned, degreased and dried as in the previous examples. Following this pre-cleaning, gilding metal was still plainly visible over the length of the bore.

The bore was then plugged, a brush inserted and a d-c power source connected as in Example 1. The bore was filled with an aqueous solution consisting of 0.25 moles/liter (19.25 grams/liter) ammonium acetate and 0.02 moles/liter copper(II) acetate. The power source was adjusted to provide an output of 0.30 volts and was capable of delivering a maximum current of 0.8 amps. The progressive removal of fouling was monitored with a DC current meter.

Removal of the gilding metal took about 37 minutes with periodic rotation of the brush within the bore. During the cleaning process the initial current of 13 milliamps decreased to 4 milliamps in 1.5 minutes, and to 3.2 milliamps in 6 minutes. Completion of the cleaning was indicated by a current level of less than 1 milliamp at about 30 minutes. The power source was switched off at 37 minutes. The pistol bore was then rinsed, dried and swabbed as in the preceding examples. As with the previous examples, the first of the two post-electrochemical cleaning, solvent-soaked patches showed appreciable dark fouling residue, even though the last solvent-soaked patch prior to electrochemical cleaning was relatively clean. Thus, the complete removal of gilding metal exposed additional organic fouling which was now easily dissolved and removed.

EXAMPLE 4

The sprue plates of two bullet molds were electrochemically cleaned of lead deposits which occur naturally during the casting of lead bullets. The electrochemical method was used to obviate the need to abrade the lead from these mold parts and thus avoid damage. While the method illustrated here is to clean the sprue plate, it can be used to remove lead deposits from other areas of a mold, especially those areas near the mold cavities which are prone to damage if the lead is removed by normal abrasion methods.

The sprue plates were taken from 9 mm and 0.45 caliber molds after casting several hundred bullets. There were light lead deposits on the top sides of the sprue plates and relatively heavy, adherent deposits on the bottom of each plate which prevented the sprue plates from lying flat on their respective molds.

Both plates were suspended in a beaker using alligator-type clips, and were electrically connected to the positive terminal of a d-c power source. A lattice, or grid-shaped structure made of lead alloy was arranged in a circle around the sprue plates and served as an auxiliary electrode. The auxiliary electrode was connected to the negative terminal of the d-c power source. The beaker was filled with the electrolyte described in Example 1 above such that the sprue plates were totally immersed. The d-c power source, which was preadjusted for 0.3 volts, was switched on to initiate the removal of lead from the sprue plates and the current was monitored with a d-c milliammeter. To enhance the rate at which the lead was removed from the sprue plates, the solution was stirred throughout the cleaning process.

The lead from one plate was completely removed in about 10 minutes while the other plate required about 16 minutes. The progress of cleaning was checked several times by rubbing the lead deposit areas with a cotton swab.

EXAMPLE 5

The inner working surface of a steel powder metallurgy die was cleaned of an adherent, lead-rich, lead oxide deposit in the following manner. The die was used to produce metal-rich lead oxide disks 1 inch in diameter and 0.5 inches in length from powdered raw material. The deposits were sufficient to impair further use of the die and required forcible removal of the mandrel. Leady oxide deposits were clearly visible, and these are typically removed by abrasive methods.

The die was first degreased with acetone on a cottom-tipped swab and permitted to air dry. The die was then plugged from one end with a suitable rubber stopper, positioned vertically and filled with an aqueous electrochemical cleaning solution consisting of 0.5 moles/liter (38.5 grams/liter) ammonium acetate and 0.02 moles/liter (6.5 grams/liter) lead(II) acetate. A brass rod auxiliary electrode having a diameter of 0.25 inches and overall length of 4 inches was then inserted into the full length of the die and positioned so as not to touch the die wall. A d-c power source capable of delivering 0–5 volts and 0–1 amp was used for the electrochemical leady oxide removal process. The positive lead was connected to the body of the die and the negative lead was attached to the auxiliary electrode. The exact location of the connection to the body of the die is not critical and in this case was conveniently made with a large copper electrical clamp.

The leady oxide removal process was initiated by switching the power source to the on position and adjusting the applied voltage to +0.3 volts. The progress of cleaning was monitored with a suitable d-c current meter. Within 15 minutes after turning on the power source, the current dropped to less than 1 milliamp, although deposits were still clearly visible within the die. This portion of the test was continued for 30 minutes without a visible change in the quantity of deposit. However, close examination of the deposits showed the remaining material no longer had a leady appearance, but instead was entirely oxide-like in appearance. The leady fraction of the deposit was obviously removed by the first stage of cleaning.

At this point, leaving the apparatus fully intact, the polarity of the applied voltage was reversed. The deposit was subsequently electrochemically reduced to metallic lead. The initial reduction current was in the order of 10 milliamps, and tapered to less than 1 milliamp in about 30 minutes. Examination of the deposits and the die now revealed a metallic lead appearance.

Again, without disrupting the apparatus, the polarity of the applied voltage was reversed back to the original condition indicated in stage one. The initial current was 15 milliamps and decreased to about 3 milliamps within the first 5 minutes of cleaning. Completion of the cleaning was signified by a rapid decrease in the measured current to a constant value of less than 1 milliamp. The power source was switched off and disconnected. The auxiliary electrode was removed and rinsed of visible leady deposits. The die was then rinsed, dried and returned to service.

In each of the examples described above, the fouling metal deposits formed on the metal shaft of the brush or other apparatus used as the auxiliary electrode were found to be quite flocculant and easily rinsed from the electrode. Thus, there is no permanent build-up of deposited metal and the brush or other type of auxiliary electrode may be used repeatedly.

The precleaning and degreasing steps used in those preceding examples relating specifically to the electrochemical cleaning of firearm bores are not necessary and may be eliminated in many cases. However, minimal precleaning and degreasing is still advisable because it enhances substantially the subsequent electrochemical process. Also, certain lubricants with which bullets are coated may form a barrier layer over the metal fouling in the bore and inhibit effective electrochemical removal. In any event, precleaning is also commonly used with conventional prior art cleaning methods and, therefore, does not add significant effort to the practice of the present invention.

In the relatively simple apparatus described hereinabove for cleaning conventional firearms, periodic manual movement of the brush (rotation and/or reciprocation) is adequate to keep the process operating efficiently and uniformly. For cleaning larger or more sophisticated arms, however, the overall utility of the method would be substantially enhanced with the use of appropriate mechanical or electro-mechanical means to brush the fouled surface or to agitate or circulate the electrolytic solution. It may also be impractical to use a full bore-length auxiliary electrode in large military arms. For example, to electrolytically clean a large-caliber artillery piece, a short auxiliary electrode of brush-like construction could be moved or reciprocated continuously at a uniform rate along the bore. This would simultaneously promote both the loosening of non-metallic deposits and the agitation of the electrolyte. Of course, complete circulation of the electrolyte, independently of any desired movement of the auxiliary electrode, could also be provided, with either a closed loop or a replacement system.

The efficiency of the electrochemical cleaning method in the preceding examples was found to be significantly enhanced where the auxiliary electrode brush was rotated or vibrated or the electrolyte was stirred during processing. When utilizing the method to remove fouling from firearms, it is believed the primary benefit derived from moving the brush is the loosening of organic and other non-metallic deposits from the fouling layer and thereby better exposing the fouling metal to the electrolytic action. However, stirring is also believed to be effective to eliminate electrolyte stratification and localized accumulations of non-metallic foulant components, both of which can inhibit uniform removal of the nonferrous metal and deposition on the auxiliary electrode.

There are believed to be a sizable number of anions the metal salts of which would be suitable and effective for use in electrolytic solutions to practice the method of the present invention. In addition to being suificiently soluble, the salts must not promote or enhance the oxidation of the ferrous base metal to be cleaned. The metal acetates and perchlorate used in the foregoing examples worked well and produced no adverse effects. The following anions, some of which are known and used in the electroplating art, are also believed to be suitable for aqueous as well as certain non-aqueous electrolytic solutions: sulfate, phosphate, borate, chloride, fluoroborate and hexafluorophosphate. In most cases and subject to solubility, the concentration of the salt in the electrolytic solution should be in the range of 0.01 to 2 moles per liter.

The non-aqueous electrolytic solution of Example 2, comprising dimethylformamide, adequately solubilized the metal salts and was innocuous to the ferrous metal bore. Similarly suitable non-aqueous solvents are believed to include acetonitrile, tetrahydrofuran and methylene chloride. Also, although the electrolytic solution used in Example 2 was doped with copper ions (copper (II) acetate), the copper ion addition is not necessary because the differential potential necessary to initiate oxidation of the fouling metal is automatically established by the potentiostat.

It is also possible to employ within the auxiliary electrode a redox agent in solid form for the purpose of sustaining the electrochemical current. Said redox agent may be selected to have sufficient oxidizing power to carry out removal of the metal fouling without the need for an external power source. In that case, the modified auxiliary electrode would be externally connected directly to the bore (or other ferrous metal to be cleaned) to initiate the cleaning process. For example, to remove lead fouling, the use of lead dioxide ($PbO_2$) as a redox agent in the auxiliary electrode will establish a redox couple to initiate and sustain the oxidation of lead. In this manner, a separate external power source may not be required.

We claim:

1. The method for selective removal of nonferrous metal deposits selected from the group consisting of copper, lead and alloys of each from ferrous base metals compirsing the steps of:

a. selecting an electrolytic solution which promotes solubilization of the nonferrous metal deposit and does not promote oxidation of the ferrous base metal;

b. selecting electrode means for supporting an electrical current to oxidize the nonferrous metal;

c. applying a controlled direct current potential between the ferrous base metal and the electrode means in the electrolytic solution such that the ferrous base metal is maintained sufficiently positive with respect to the electrode means to oxidize the nonferrous metal without actively oxidizing the ferrous base metal; and, d. maintaining the potential for a time sufficient to remove the nonferrous metal.

2. The method as set forth in claim 1 wherein the electrode means comprises in combination a reference electrode and an auxiliary electrode and the potential is applied with a potentiostat.

3. The method as set forth in claim 1 wherein the electrode means comprises an auxiliary electrode and the potential is applied with a direct current power source and including the step of controlling the potential by preferentially doping the electrolytic solution with ions of the nonferrous metal.

4. The method for electrolytically removing nonferrous metal fouling selected from the group consisting of copper, lead and alloys of each from the ferrous metal bore of a firearm comprising the steps of:

a. selecting an eletrolytic solution having dissolved therein ions of the metal to be removed, which electrolytic solution promotes solubilization of the metal to be removed and does not promote oxidation of the ferrous metal bore;

b. inserting an auxiliary electrode into the bore;

c. maintaining the auxiliary electrode spaced and electrically insulated from the bore;

d. filling the space between the bore and the electrode with the electrolytic solution;

e. applying a direct current potential between the bore and the auxiliary electrode with the bore maintained electrically positive with respect to the auxiliary electrode to oxidize the metal fouling without actively oxidizing the ferrous metal bore; and, f. maintaining the potential until the metal fouling is removed.

5. The method as set forth in claim 4 wherein the auxiliary electrode extends along substantially the entire length of the bore.

6. The method as set forth in claim 5 wherein the auxiliary electrode comprises the shaft of a brush and includes non-conducting bristles to maintain electrical insulation of the electrode from the bore.

7. The method as set forth in claim 5 wherein the electrolytic solution comprises a solution of ammonium and the nonferrous metal salts of at least one anion selected from the group consisting of acetate, nitrate, phosphate, sulfate, borate, chloride, fluoroborate and hexafluorophosphate.

8. The method as set forth in claim 7 wherein the electrolytic solution comprises an aqueous solution of acetates of ammonium and the nonferrous metal.

9. The method as set forth in claim 7 wherein the concentration of salts in the electrolytic solution is in the range of 0.01 to 2 moles per liter.

10. The method for electrolytically removing nonferrous metal fouling selected from the group consisting of copper, lead and alloys of each from the ferrous metal bore of a firearm comprising the steps of:

a. selecting an electrolytic solution which promotes the solubilization of the metal to be removed and does not promote oxidation of the ferrous metal bore;

b. inserting an auxiliary electrode into the bore along subtantially its entire length;

c. maintaining the auxiliary electrode spaced and electrically insulated from the bore;

d. filling the space between the bore and the electrode with the electrolytic solution;

e. applying a potentiostatically controlled direct current potential between the bore and a reference electrode in the bore with the bore maintained electrically positive with respect to the auxiliary electrode to oxidize the metal fouling without actively oxidizing the ferrous metal bore; and, f. maintaining the potential until the metal fouling is removed.

11. The method as set forth in claim 10 wherein the auxiliary electrode extends along substantially the entire length of the bore.

12. The method as set forth in claim 11 wherein the auxiliary electrode comprises the shaft of a brush and includes non-conducting bristles to maintain electrical insulation of the electrode from the bore.

13. The method as set forth in claim 11 wherein the electrolytic solution comprises a solution of ammonium and the nonferrous metal salts of at least one anion selected from the group consisting of acetate, nitrate, phosphate, sulfate, borate, chloride, fluoroborate and hexafluorophosphate.

14. The method as set forth in claim 13 wherein the electrolytic solution comprises an aqueous solution of acetates of ammonium and the nonferrous metal.

15. The method as set forth in claim 13 wherein the concentration of salts in the electrolytic solution is in the range of 0.01 to 2 moles per liter.

16. Apparatus for electrochemically removing bullet-metal fouling selected from the group consisting of copper, lead and alloys of each from the ferrous metal bore of a firearm barrel comprising means for temporarily sealing one end of the bore, an auxiliary electrode having a diameter less than the bore diameter and adapted to be inserted into the bore along substantially the entire axial length thereof, separator means surrounding at least a portion of the auxiliary electrode for maintaining separation of and electrically insulating the electrode from the barrel, an electrolytic solution within the bore between the surface thereof and the auxiliary electrode, the electrolytic solution being chemically and electrochemically innocuous to the ferrous metal bore and capable of solubilizing the electrolytically oxidized metal fouling, a source of controlled direct current potential, and means for applying the controlled potential between the barrel and the auxiliary electrode such that the barrel is maintained electrically positive with respect to the auxiliary electrode.

17. Apparatus as described in claim 16 wherein the auxiliary electrode and the separator means comprise, respectively, the rod and bristles of a brush.

18. Apparatus as described in claim 17 wherein the auxiliary electorde has a length not less than the length of the bore.

19. Apparatus as described in claim 17 including means for moving the brush within and relative to the bore.

20. Apparatus as described in claim 16 including means for circulating the electrolytic solution through the bore.

21. The method for selective removal of adherent nonferrous oxide deposits of metals selected from the group consisting of copper, lead and alloys of each from ferrous base metals comprising the steps of:

a. selecting an electrolytic solution which promotes solubilization of the nonferrous metal specie of the deposit and does not promote oxidation of the ferrous base metal;

b. selecting electrode means for supporting an electrical current;

c. applying a controlled direct current potential between the electrode means and the ferrous base metal in the electolytic solution such that the electrode means is maintained sufficiently positive with respect to the ferrous base metal to reduce the nonferrous metal oxide to the nonferrous metal;

d. maintaining the potential until the current drops essentially to zero;

e. reversing the polarity of the applied potential to oxidize the nonferrous metal without actively oxidizing the ferrous base metal; and, f. maintaining the reversed potential until the current drops essentially to zero.

* * * * *